US008020547B2

(12) United States Patent
Hepper et al.

(10) Patent No.: US 8,020,547 B2
(45) Date of Patent: Sep. 20, 2011

(54) PELLET STOVE

(75) Inventors: Larry Hepper, Ridgefield, WA (US); Carl Williamson, Battle Ground, WA (US)

(73) Assignee: Clarry Pellet Stove, LLC, Lake Oswego, OR (US)

( * ) Notice: Subject to any disclaimer, the term of this patent is extended or adjusted under 35 U.S.C. 154(b) by 140 days.

(21) Appl. No.: 11/890,688

(22) Filed: Aug. 6, 2007

(65) Prior Publication Data

US 2009/0038603 A1 Feb. 12, 2009

(51) Int. Cl.

| | |
|---|---|
| ***F24B 13/04*** | (2006.01) |
| ***F24B 1/08*** | (2006.01) |
| ***F24B 1/16*** | (2006.01) |
| ***F24C 1/14*** | (2006.01) |
| ***F24C 1/16*** | (2006.01) |
| ***F24C 15/26*** | (2006.01) |
| ***F23K 3/00*** | (2006.01) |
| ***F23B 50/00*** | (2006.01) |

(52) U.S. Cl. ..... 126/73; 126/4; 126/11; 126/59; 126/223; 126/9 R; 110/293; 110/233

(58) Field of Classification Search ..... 126/3, 4, 126/58, 59, 60, 71, 72, 73, 100, 222, 223, 126/64, 65, 7, 10, 11, 68, 107, 201; 110/293
See application file for complete search history.

(56) References Cited

U.S. PATENT DOCUMENTS

| | | | | | |
|---|---|---|---|---|---|
| 137,727 | A | * | 4/1873 | Seward | 126/104 R |
| 204,170 | A | | 5/1878 | Shepard | |
| 239,177 | A | * | 3/1881 | MacDonald | 126/58 |
| 425,320 | A | * | 4/1890 | Harkins | 126/1 AE |
| 1,328,743 | A | * | 1/1920 | Lanum | 126/60 |
| 1,382,014 | A | * | 6/1921 | Rowley | 126/58 |
| 2,391,460 | A | * | 12/1945 | Howard | 126/1 R |
| 2,540,657 | A | * | 2/1951 | Crumbaker | 110/175 R |
| 2,852,016 | A | * | 9/1958 | Weatherwax | 126/9 R |
| 3,124,057 | A | * | 3/1964 | Kiser | 99/340 |
| 3,845,753 | A | * | 11/1974 | Jackson | 126/9 R |
| 3,888,231 | A | * | 6/1975 | Galluzzo et al. | 126/501 |
| 4,102,279 | A | * | 7/1978 | Groschl et al. | 110/234 |
| 4,192,285 | A | * | 3/1980 | Nietupski | 126/83 |
| 4,215,814 | A | * | 8/1980 | Ebert | 236/1 G |
| 4,432,335 | A | * | 2/1984 | Kilham | 126/60 |
| 4,438,756 | A | | 3/1984 | Chamberlain et al. | |
| 4,517,903 | A | | 5/1985 | Richmond et al. | |
| 4,559,882 | A | * | 12/1985 | Dobson | 110/254 |
| 4,565,184 | A | | 1/1986 | Collins et al. | |
| 4,611,572 | A | * | 9/1986 | Martenson | 126/77 |
| 4,803,973 | A | * | 2/1989 | Harman | 126/73 |
| 4,827,900 | A | * | 5/1989 | Bonner | 126/60 |
| 4,911,140 | A | * | 3/1990 | Robinson | 126/59 |
| 4,989,521 | A | * | 2/1991 | Traeger et al. | 110/108 |

(Continued)

OTHER PUBLICATIONS

Office action dated Apr. 1, 2009, issued in co-pending Canadian Application No. 2,604,313.

*Primary Examiner* — Steven B McAllister
*Assistant Examiner* — Frances H Kamps
(74) *Attorney, Agent, or Firm* — Klarquist Sparkman, LLP

(57) ABSTRACT

A pellet stove is disclosed comprising a reverse flow heated air pathway defined by stove sections. In an illustrated embodiment, the space between upper and lower stove sections is open to provide a heating or oven area. The stove can be readily disassembled in part for easy portability.

26 Claims, 6 Drawing Sheets

U.S. PATENT DOCUMENTS 5,123,360 A 6/1992 Burke et al.
5,144,939 A * 9/1992 Christopherson ..... 126/25 R
5,183,028 A * 2/1993 Traeger et al. ..... 126/73
5,203,316 A * 4/1993 Pritchett ..... 126/29
5,251,607 A * 10/1993 Traeger et al. ..... 126/25 R
5,285,738 A * 2/1994 Cullen ..... 110/233
5,295,474 A * 3/1994 Whitfield et al. ..... 126/152 R
5,429,110 A * 7/1995 Burke et al. ..... 126/25 R
5,797,333 A * 8/1998 Hensley ..... 110/233
5,906,196 A * 5/1999 Measom ..... 126/304 A
5,983,885 A * 11/1999 Jarvi ..... 126/73
5,983,886 A * 11/1999 Allbeck ..... 126/271.2 B
6,223,737 B1 * 5/2001 Buckner ..... 126/25 R
6,397,833 B1 6/2002 Jarvi
6,681,759 B2 * 1/2004 Bentulan ..... 126/25 R
7,237,547 B1 * 7/2007 Bourgeois ..... 126/9 R
7,311,343 B2 * 12/2007 Callebresi ..... 294/15
7,426,928 B2 * 9/2008 Sanders et al. ..... 126/30
7,665,406 B2 * 2/2010 Krumrei ..... 110/165 R
7,861,707 B2 * 1/2011 Wisener ..... 126/68
2007/0186920 A1 * 8/2007 Wisener ..... 126/77
2008/0060632 A1 * 3/2008 Leverty ..... 126/1 R
2008/0276450 A1 * 11/2008 Kozina et al. ..... 29/700
2009/0107483 A1 * 4/2009 Fitzgerald et al. ..... 126/519

* cited by examiner

PELLET STOVE

TECHNICAL FIELD

The technology disclosed herein relates to stoves that burn pellet fuel.

BACKGROUND

Stoves that burn pellet fuel are known. These stoves typically burn a pelletized fuel which can be comprised of compressed wood products such as sawdust. Although variable, an example of pelletized fuel are pellets that are about one-quarter inch in diameter and from about one-half to one and one-half inches long. Thus, pellet stoves burn pellets of compressed combustible particulate materials with or without other ingredients.

Some known pellet stoves use an auger or other powered feed mechanism for delivery of pellets to the stove for combustion. These delivery mechanisms can be complex and require a power source, which makes such stoves impractical for use in remote locations.

Some other known pellet stoves can burn inefficiently.

Therefore, a need exists for an improved pellet burning stove.

SUMMARY

In accordance with one embodiment, a pelletized stove is disclosed which is compact and relatively light weight so as to be portable for use in remote locations, such as in a hunter's tent or an ice fish house.

In accordance with an embodiment, a pellet stove can provide an air flow path from a combustion chamber that reverses direction as air travels along the flow path. A specific example is a generally J-shaped combustion chamber and flow path with one leg of the J being generally horizontal when the pellet stove is in use.

In accordance with another aspect of an embodiment, pellets can be delivered to combustion chamber from a hopper by gravity.

As yet another aspect of an embodiment, pellets reaching the combustion chamber portion of the stove can be guided, such as by a feed tube, onto an apertured grate with a flow of combustion air passing at least partially upwardly through the grate and pellets thereon to facilitate burning of the pellets.

As a still further aspect of an embodiment, an ash receiving drawer can be positioned beneath the combustion chamber with the ash receiving drawer being partially opened to provide enhanced combustion air flow through the ash receiving drawer and to the underside of an apertured grate supporting pellets thereon.

As yet another aspect of an embodiment, detachable legs can be used to support the pellet stove with the legs being adjustable in elevation to facilitate leveling of the stove.

As a still further aspect of an embodiment, the combustion chamber and air flow path can be tubular comprising a first tubular section having a combustion chamber at one end portion thereof and having a longitudinal axis that is oriented approximately horizontally when the stove is leveled, a second upright tubular section and a third elongated tubular section having a longitudinal axis that also can be approximately horizontal when the stove is leveled for use. In an exemplary feature of a desirable embodiment, the first and third sections can be spaced apart by the second section and with the third section can at least partially, and desirably entirely, overlie the first section with a space provided therebetween. The space can be an open cooking zone which can function as an oven.

In accordance with yet another more specific aspect of an embodiment, the sections can be of rectangular cross-section.

As yet another aspect of an embodiment, upwardly projecting handles can be provided along respective sides of the first section with the handle portions being spaced apart, for example, by the first section. The handles can comprise elongated rails which provide a cookware supporting surface upon which cookware may be placed between the first and second sections to cook food therebetween.

As yet another aspect of an embodiment, the first section can comprise an end with an end cap coupled thereto for movement between open and closed positions. When the end cap is open, access can be provided to a pellet supporting grate within the combustion chamber to permit removal and cleaning of the grate.

These and other aspects and features of various embodiments are explained more fully in the disclosure below by way of examples. The invention is not limited to these specific examples but instead is defined by the claims set forth in this application. It should be noted that the invention is directed toward all novel and non-obvious aspects of a pellet stove in accordance with this disclosure, and methods of operating and assembling such a stove, both alone in various combinations and sub-combinations with one another.

DETAILED DESCRIPTION

Figure 1:
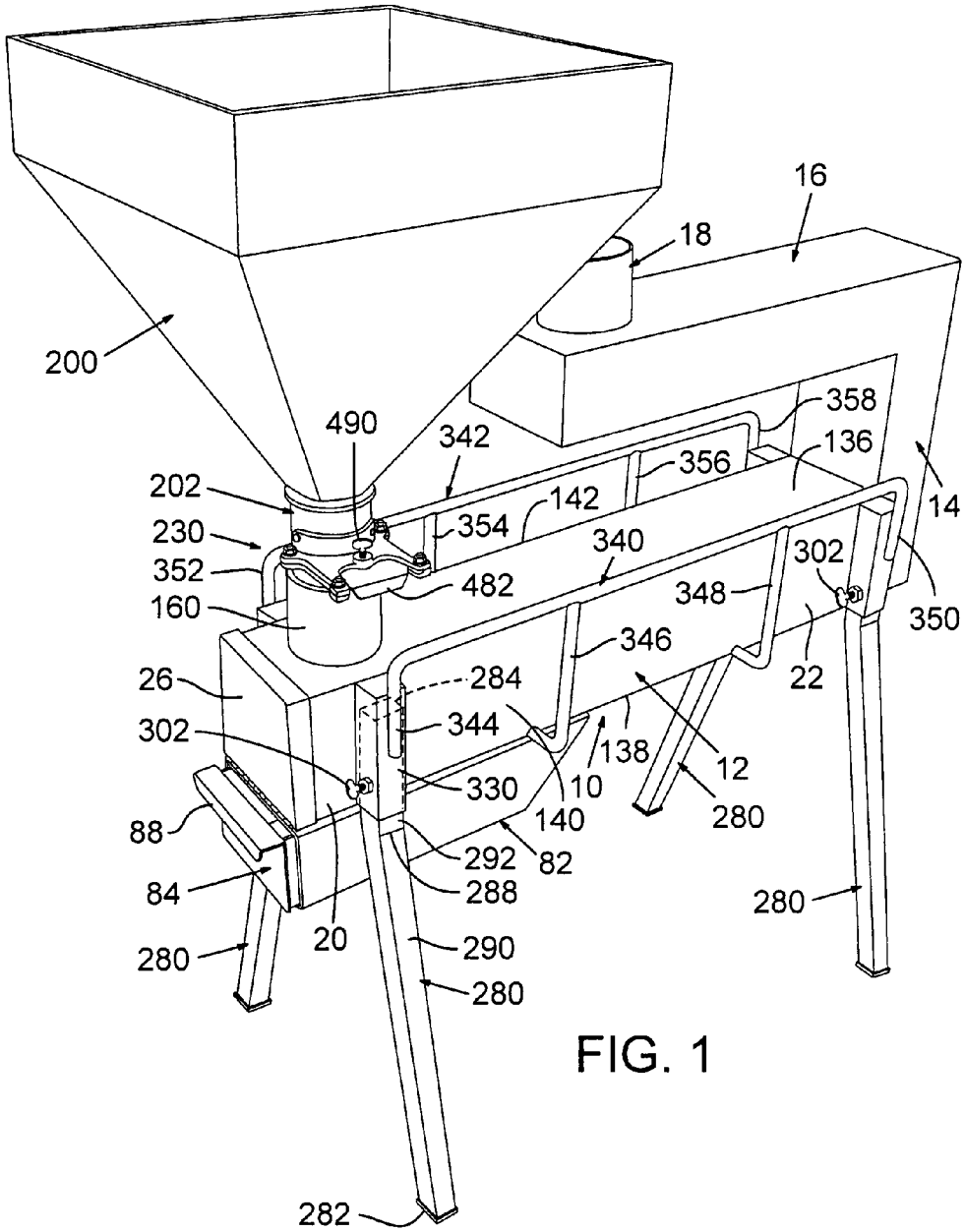
FIG. 1 is a perspective view of one embodiment of a pellet stove shown supported by a plurality of legs.

With reference to FIGS. 1-4, an exemplary pellet stove in accordance with one embodiment of the disclosure comprises a stove body 10 comprising a first body section 12, a second body section 14, a third body section 16 and a vent coupling portion 18. The first body section 12 can be elongated with a longitudinal axis and can comprise a first end portion 20 and a second end portion 22. As can be best seen in FIG. 3, end portion 20 has an end 24 that can be selectively closed by an end cap 26. End cap 26 can be shifted from a first closed position shown in FIG. 3 to an open position (a partially open position being shown in FIG. 2) so as to permit the removal of a fuel support such as an apertured pellet supporting grate 30 through the end 24 of the first section 12. Access to the pellets for initially lighting the pellets can be achieved through the open end cap. In the embodiment shown in FIG. 3, end cap 26 is hinged along a lower edge thereof, such as indicated by hinge 40 to permit pivoting of the end cap in the directions indicated by arrow 42 between open and closed positions. A portion 50 of end portion 20 of the first section 12 can comprise a combustion chamber or combustion zone. The grate 30 supports pellets, some being indicated at 60 in FIG. 3, in a combustion zone of the combustion chamber 50 wherein the pellets can burn.

The sections 12, 14, 16 and 18 comprise conduit sections in this example. The conduit section 12 defines an outlet 62 through which heated air such as indicated by arrows, some of which are numbered in FIG. 3 with the number 70, pass from the combustion chamber portion 50. A combustion air flow passageway is provided to deliver combustion air to the combustion chamber. This combustion air is represented by arrows in FIG. 3, with some of the arrows being indicated by the number 74. At least some of the combustion air, and desirably all of the combustion air, flows upwardly through the pellet supporting grate 30 and through pellets supported thereon. An elongated opening 80 is provided in section 12 below the grate 30 through which the combustion air can pass. An ash drawer receiving housing 82 can be coupled to the first section 12 for receiving an ash drawer 84 which can be slidable, such as indicated by arrows 86, into the drawer receiving housing 82. An ash drawer handle 88 can be used to facilitate movement of the ash receiving drawer into and out of the housing 82. The ash receiving drawer can be open at the top so that ashes from consumed pellets can pass downwardly through apertures in the grate, one of such apertures being indicated by the number 90 in FIG. 3.

Figure 3:
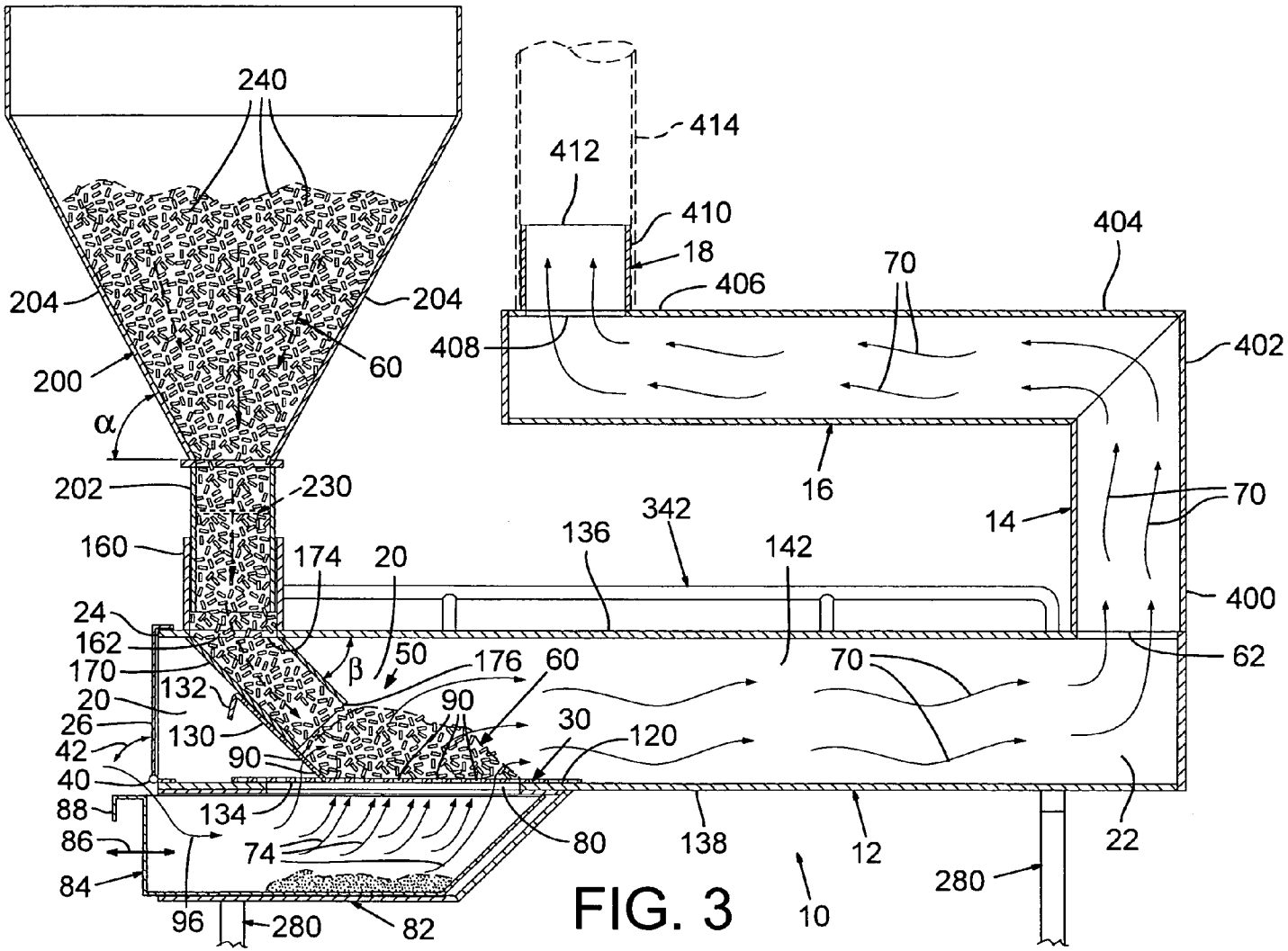
FIG. 3 is a vertical sectional view through a portion of the pellet stove of FIG. 1.

The ash receiving drawer 84 can be shifted to partially open positions, such as to one such position shown in FIG. 3, to increase the combustion air flow (see arrow 96) into the ash receiving drawer and upwardly through the apertures 90. In a typical example, although variable, the drawer is open approximately one and one-half inches to provide a draft for the burning fuel. The ash drawer 84 in the illustrated embodiment can be entirely removed to facilitate dumping of the ash.

Figure 2:
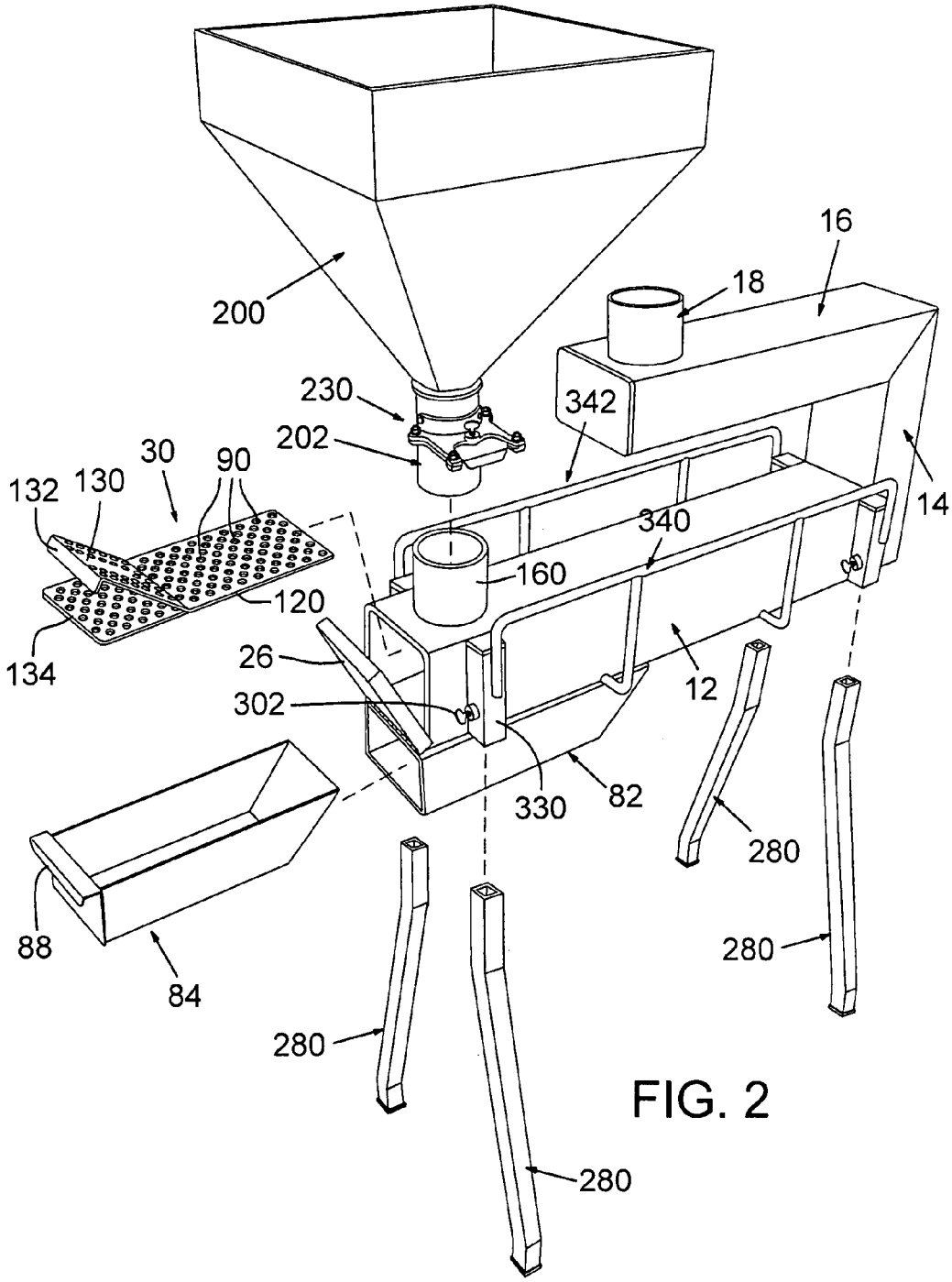
FIG. 2 is an exploded view of the stove of FIG. 1 with selected detachable components of the stove shown detached from the assembled stove.
Figure 8:
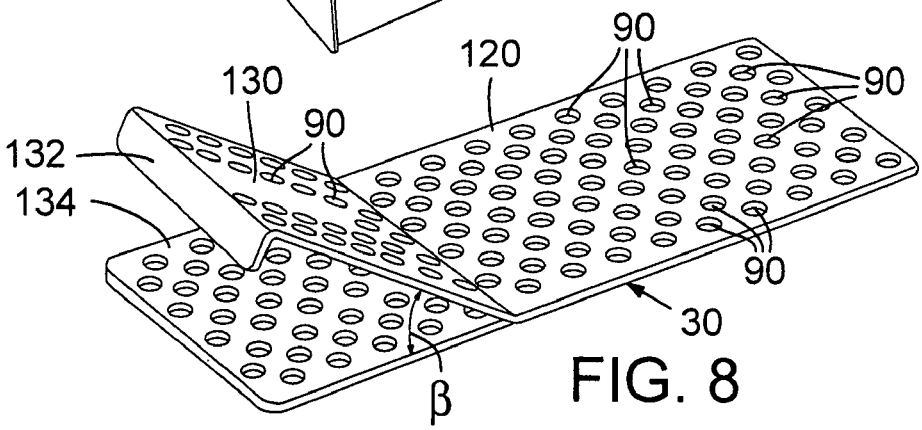
FIG. 8 is an exemplary pellet supporting grate having apertures therethrough for permitting the access of combustion air upwardly through the grate to pellet fuel supported thereon.

The grate 30 in one exemplary form is shown more clearly in FIGS. 2 and 8. The illustrated grate comprises a base, such as a plate-like body portion 120 having the apertures 90 therethrough. Exemplary apertures are approximately one-half inch in diameter, although this size can be varied. Any durable material can be used for the grate with one-eighth inch stainless steel being a specific exemplary material. The illustrated grate also comprises an upwardly angled stop portion 130 having a downturned lip or handle 132 at a distal end thereof spaced from the location where the plate 130 is coupled to plate 120. A rear portion 134 of the plate 120 is positioned generally beneath the upright portion 130 with the upright portion extending at an acute angle β relative to the base in this example.

With reference to FIG. 1, the illustrated first housing section 12 comprises an upper surface 136, a lower surface 138, and first and second side surfaces 140,142 (it being understood that these side surfaces would be curved if section 12 were, for example, of right cylindrical construction). With this construction, referring again to FIG. 3, the opening 80 can be an elongated opening, that is elongated in the lengthwise direction, and, for example, can be rectangular with the opening 80 extending through the lower surface 138.

The illustrated exemplary embodiment of FIGS. 1 and 2 comprises an upwardly extending hopper-neck receiving sleeve 160 that can, for example, be of a right cylindrical construction. A pellet fuel inlet opening 162, which can be of circular cross-section, is provided through upper surface 136 at the base of the sleeve 160 through which pellets can be delivered to the combustion chamber 50. A pellet guiding or feed tube 170 can have an open upper end portion 174 communicating with the opening 162 through which pellet fuel can be delivered. The tube 170 can also comprise a lower end portion 176 with an outlet opening through which pellets can pass onto the grate 34. The tube 170 can be angled away from end 24 and toward the combustion chamber zone 50. Although variable, this angle can also be at the angle β. An exemplary angle β is 45°, although variable. The angled feed tube assists in moving pellets away from the hopper opening toward the combustion zone. In this case, as can be seen in FIG. 3, the grate 30 can be inserted into the end section 20 through end 24 until plate 130 engages the outer surface of feed tube 170, thereby limiting the depth of insertion of the grate 30. Thus, plate 130 and feed tube cooperate to stop the insertion of the grate at the appropriate location. Other forms of stops can be used if desired.

A hopper 200 is shown (FIGS. 1 and 3) for receiving pellets 60 therein. The illustrated hopper comprises a neck portion 202 which also can be cylindrical in cross-section or otherwise shaped to mate with sleeve 160. The hopper thus can be loosely positioned within sleeve 160, although set screws and other types of fasteners could be used if desired. Disassembly of the hopper from the remaining portions of the stove is facilitated by such a loose connection. The hopper comprises side walls 204 which can be angled, such as at the angle α from horizontal as shown in FIG. 3. Although variable, a specific example of α is 62 degrees. The hopper can be of other sizes and shapes. When a gate 230 (explained in greater detail below) is operated to open the base of the hopper, pellets travel under the influence of gravity, in the direction indicated for example by arrows 240, downwardly through the hopper neck 202, the sleeve 160, the pellet fuel inlet opening 162, the feed tube 170, and through the end 176 of the feed tube 170 to the combustion zone 50 and on to the grate 30. The distance between the bottom edge of the feed tube 170 and the upper surface of the grate 130 can be varied by varying the length of the feed tube and/or the size of the combustion chamber to assist in controlling the size of the pellet pile in the combustion zone. In general, the more pellets and larger the pile permitted in the combustion zone, the hotter the resulting fire. Exemplary distances between the bottom edge of the tube and the grate are from about one-half inch to one and one-half inches with one inch being a specific example for a stove having a first section made out of six inch square steel tubing. Another specific example would be one-half inch spacing for a stove having a first section of 6 inch wide by 3 inch high rectangular steel tubing.

As can be seen in FIG. 1, a plurality of legs 280, such as two front legs and two rear legs, can be used to support the stove. Since these legs can be identical and can be identically coupled to the stove, such as to the first section 12 and more specifically to side walls thereof in one example, only one of such legs 280 and associated coupling components will be described in detail. In particular, leg 280 can be of a tubular construction, such as of a square cross-section. The leg can comprise a lower end portion 282 and an upper end portion 284. The leg can be bent, for example, at 288 (FIG. 1) so that a lower portion of the leg 290 flares outwardly while an upper portion of the leg 292 can be oriented in an upright, for example vertical, orientation when the stove is assembled. A sleeve 300 can be coupled to the first stove section 12, such as by welding or otherwise securing the sleeve 300 to wall 140 thereof. In this disclosure, the term "coupled to" includes both direct connection of two components together and indirect connection of two components through one or more other components. The sleeve can be closed at its upper end and open at its lower end so as to slidably receive the end portion 292 of leg 280 therein. By sliding leg end portion 292 into and out of the sleeve, the elevation of the stove can be adjusted. A level holding mechanism, such as a set screw 302, threadedly received by sleeve 300 and engageable with leg section 292, can be provided to hold the leg at its desired elevational adjustment.

Figure 4:
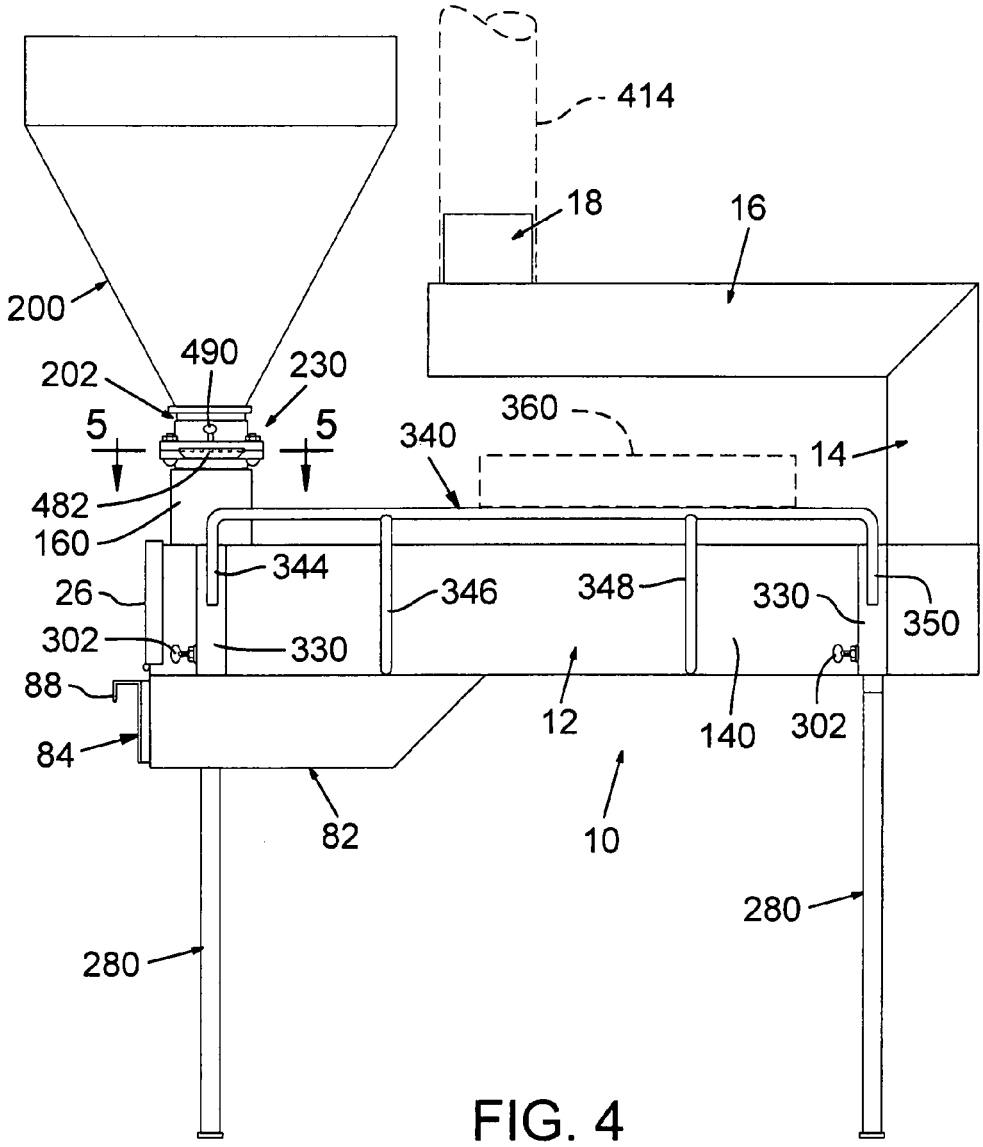
FIG. 4 is a side elevational view of the pellet stove of FIG. 1, with two of the legs removed for purposes of showing the rest of the stove more clearly.
Figure 5A:
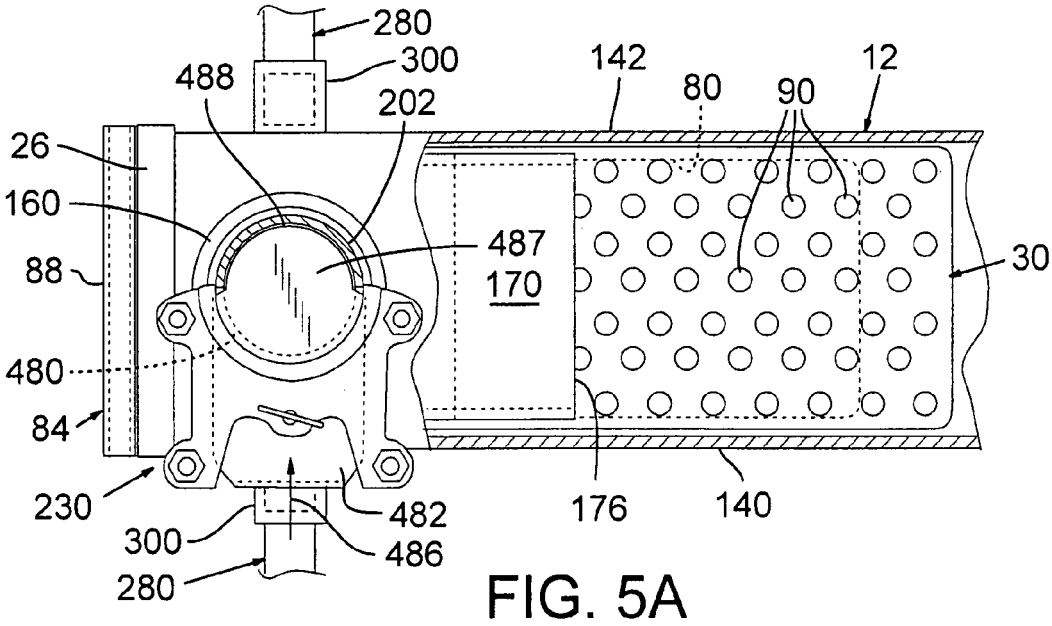
FIGS. 5A and 5B illustrate an exemplary pellet fuel supply gate coupled to a hopper of a pellet stove for use in controlling the delivery of pellet fuel to the combustion chamber of the stove.
Figure 5B:
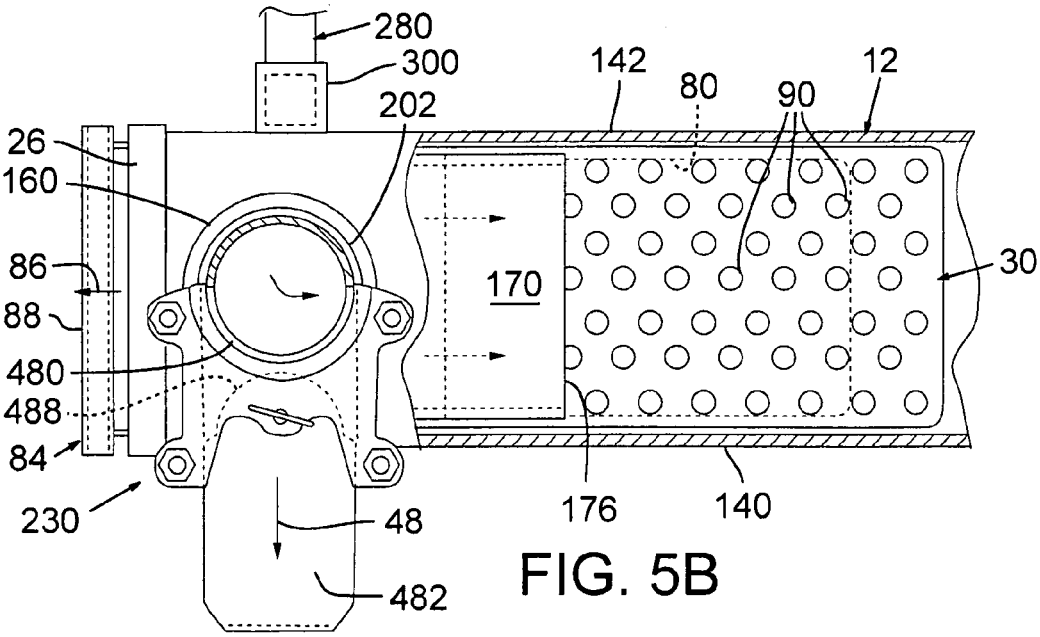
Figure 6:
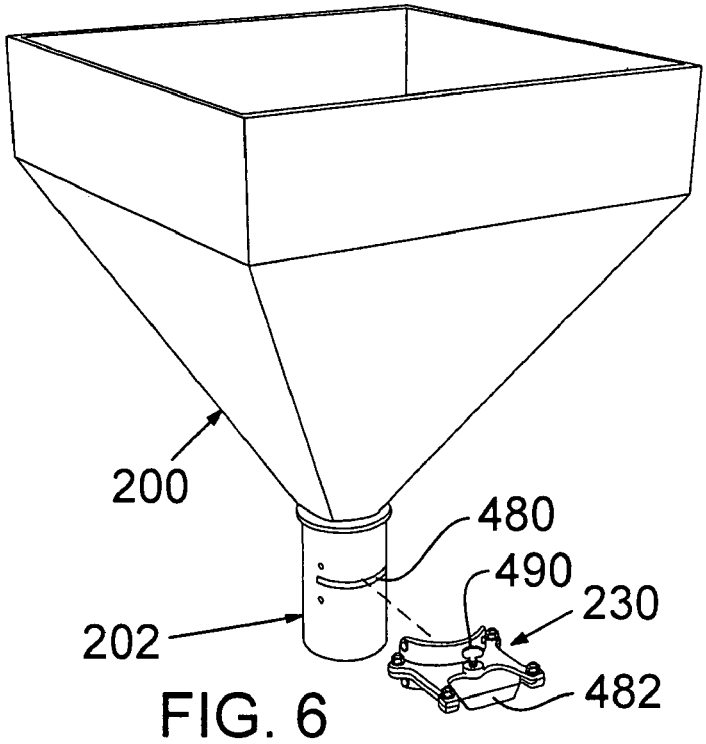
FIG. 6 illustrates an exemplary hopper which can be used in the pellet stove of FIG. 1, together with an exemplary gate, such as shown in FIGS. 5A and 5B, shown detached from the hopper.
Figure 7:
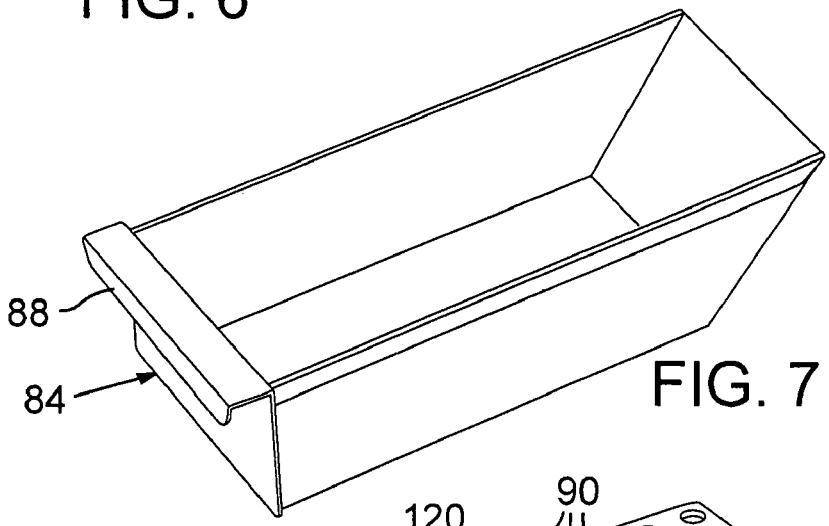
FIG. 7 is an exemplary ash receiving drawer which can be included in the pellet stove of FIG. 1.

As also can be seen in FIGS. 1 and 4, the illustrated stove can comprise handles to facilitate lifting of the stove. An exemplary stove without the hopper weighs under 100 pounds. For example, for a stove comprising a first section 12 of 6 inches wide by 6 inches high by 39 inches long by 3/16 inch thick steel; a second section 14 of 6 inches wide by four inches deep by 11 inches long (at longest point) by 1/8 inch thick steel; a third section of 6 inches wide by four inches deep by 24 inches long (at longest point) by 1/8" thick steel, with coupler section 18, the hopper sleeve 160, feed tube 170, grate 30, end cap 26, ash drawer housing 82, ash drawer 84, and legs 280 and without the hopper 200 weighs about 96 pounds, making the stove readily portable. Of course, the stove can be made to any size larger or smaller than the specific dimensions described above.

In a specifically illustrated example, the handles comprise respective first and second handles with elongated rails 340, 342 being exemplary handles. These rails 340,342 are supported by respective upright supports 344,346,348 and 350 for rail 340 and 352,354,356 and 358 for rail 342. The rails shown in this example extend upwardly above the upper surface 136 of first section 12. As can be seen in FIG. 4, cookware, such as a baking pan or fry pan 360, can be supported by the rails above the surface 136 and in the space between sections 12 and 16. This space can be, for example, about 8 inches between surface 136 of section 12 and the lower surface of section 16. This space can be at least partially open (unobstructed), door-free, and desirably is entirely unobstructed except by the handles, and can be entirely unobstructed at one side thereof except by the handles. The space can be open substantially as shown and in effect can be used as an oven. The temperature in this space can be varied and can, for example, be 450° F. between tube sections 12 and 16 in this heating zone. In addition, in the example wherein rails 340,342 extend upwardly above the surface 136, when the legs are detached from the stove, the legs can be placed and stored on upper surface 136 with the rails 340,342 holding the legs in place, making them easier to transport with the stove.

Referring again to FIG. 3, the illustrated stove or body section 14 comprises a lower portion 400 having an inlet communicating with the outlet 62 of first section 12. Section 14 also comprises an upper end portion 402 having an outlet communicating with an inlet at a first end portion 404 of the section 16. The opposite end portion 406 of housing section 16 comprises an outlet 408 communicating with an inlet of a vent coupler portion 410 having an outlet 412. A vent, such as a stove pipe, 414 can be coupled to vent coupler 410 for exhausting the stove as desired. For example, stove pipe 414 can communicate through the roof or side wall of a hunter's tent. Thus, as can be seen from FIG. 3, combustion air 96 entering the ash drawer 84 flows upwardly through the grate 30, as indicated by arrows 74, and is heated in the combustion chamber zone 50. The heated air 70 travels along the length of the first section 12, upwardly into the second section 14, and through the third section 16 in a direction reversed from the flow direction through the section 12. The heated air exits through the coupler 18.

As can be seen from FIGS. 2, 4, 5A, 5B and 6, the hopper neck portion 202 can be provided with a gate receiving slit 480 extending, for example, halfway into the neck 202. A commercially available manually actuated gate 230 can be used to control the flow of pellet fuel from the hopper and into the combustion chamber of the stove. The gate 230 can comprise a sliding member 482 movable in a direction of arrow 44 in FIG. 5B to open the gate and in a direction of arrow 486 in FIG. 5 to close the gate. An end portion 487 of the slide member 482 can have a configuration shaped to close the neck 202 when the gate is in a closed position. For example, end portion 487 can have a semi-circular peripheral edge portion 488 which bears against the interior surface of the unslit portion of a circularly configured neck 202. A locking mechanism, such as a set screw 490, can be used to selectively lock the gate in the position to which it has been moved.

In some embodiments of the pellet stove, the stove burns for about eight hours with one 40-lbs. bag of pellets as fuel, i.e., at an approximate average burn rate of about 5 lbs. per hour. In another embodiment of a smaller-sized pellet stove, the burn rate may approach approximately 2.5 lbs. per hour.

Various components of the stove may be finished with baked on stove paint. The grates may be constructed of stainless steel.

Having illustrated and described the principles of our invention with reference to a illustrated embodiments, it should be apparent to those of ordinary skill in the art that these embodiments may be varied in arrangement and detail without departing from the inventive principles set forth herein. We claim all such variations which fall within the scope of the following claims.

The invention claimed is:

1. A pellet stove comprising:

a stove body comprising an elongated first stove body section with a first end portion and a second end portion, the first stove body section comprising an upper surface, a lower surface and first and second side surfaces;

a portion of the first end portion of the first stove body section comprising a combustion chamber a pellet material inlet extending through the upper surface and positioned at an upper portion of the combustion chamber such that pellets to be burned travel downwardly under the influence of gravity through the pellet material inlet and into the combustion chamber;

an apertured pellet supporting grate positioned in the combustion chamber to receive pellets delivered through the pellet material inlet, plural apertures of the pellet supporting grate being positioned such that a combustion air passageway extends upwardly through plural of said apertures to the combustion chamber;

a combustion air inlet communicating with the combustion air passageway to deliver combustion air to the combustion air passageway and through the plural apertures of the pellet supporting grate to the combustion chamber upon opening the combustion air inlet, at least a portion of the combustion air being delivered so as to flow upwardly through plural apertures of the pellet supporting grate and into the combustion chamber;

an air flow path comprising a first section comprising a first end portion communicating with the combustion chamber and a second end portion spaced from the combustion chamber and within the second end portion of the first stove body section, the second end portion comprising a first outlet portion and a second end adjacent to the second end portion, the first section extending in a first direction away from the combustion chamber toward the second end portion, a second upright section having a second inlet portion communicating with the first outlet portion, the second section also comprising a second outlet portion, the second section extending in a second upwardly extending direction away from the first section, a third section having a third inlet portion communicating with the second outlet portion, the third section comprising a third outlet portion, the third section extending in a third direction so as to be spaced from the first section and so as to at least partially overlie the first section, the first and third sections defining an at least partially open zone therebetween, and a fourth vent coupling section comprising a fourth vent inlet portion coupled to the third outlet portion, the fourth vent coupling section comprising a fourth vent outlet portion, wherein when the pellet stove is operated to burn pellets in the combustion chamber, heated air travels through the air flow path in succession from the combustion chamber, through the first section, the first outlet portion, the second inlet portion, the second section, the second outlet portion, a third inlet portion, the third section, the third outlet portion, the fourth vent inlet portion, the fourth vent coupling section, and the fourth outlet portion;

a pellet guiding tube extending into the combustion chamber, the pellet guiding tube having a pellet guiding tube inlet communicating with the pellet material inlet and a pellet guiding tube outlet, the pellet guiding tube comprising an end portion that extends downwardly and inwardly into the combustion chamber from the pellet material inlet such that the end of the pellet guiding tube outlet is positioned in the combustion chamber at a location that is downwardly and inwardly in the first direction relative to the pellet material inlet and defining a pellet flow path from the pellet guiding tube inlet to the pellet guiding tube outlet that directs the travel of the pellets generally both downwardly and in the first direction toward the second end portion of the first section as the pellets travel from the pellet guiding tube inlet to the pellet guiding tube outlet;

the pellet supporting grate comprising an apertured portion positioned below the pellet guiding tube and extending in the first direction beyond the pellet guiding tube outlet and toward the second end portion of the first section such that at least a plurality of apertures of the grate are positioned at locations spaced in the first direction from the pellet guiding tube outlet and nearer to the second end of the first section than the pellet guiding tube outlet to provide a path for the flow of at least some of the combustion air through plural apertures of the grate at locations nearer to the second end of the first section than the end of the pellet guiding tube outlet: and wherein the combustion air passageway is defined at least in part by an ash drawer receiving housing positioned below the pellet supporting grate with the combustion air inlet being at one end portion of the ash drawer receiving housing, and comprising an ash receiving drawer positioned beneath the pellet supporting grate when the ash receiving drawer is either inserted into the ash drawer receiving housing to a closed position or partially removed from the ash drawer receiving housing to partially open positions, the ash receiving drawer comprising an end portion sized to cover the combustion air inlet when the ash receiving drawer is in the closed position and to uncover the combustion air inlet to increase the access of combustion air through the combustion air inlet opening and upwardly into the combustion chamber as the ash receiving drawer is moved from the closed position to partially open positions or from one partially open position to a further open partially open position.

2. A pellet stove according to claim 1 wherein the at least partially open zone comprises an area between the first and third sections that is open so as to be accessible from either side of the pellet stove and wherein the first section comprises an upper wall and the third section comprises a lower wall, the upper wall bounding a portion of the at least partially open zone and the lower wall bounding a portion of the at least partially open zone.

3. A pellet stove according to claim 2 further comprising elongated rails mounted in a fixed position to the first section and defining stove lifting handles, the rails being spaced apart from one another on opposed sides of the open zone.

4. A pellet stove according to claim 1 wherein the first, second and third sections are each tubular with the combustion chamber comprising a portion of the first section.

5. A pellet stove according to claim 1 wherein the grate comprises a plate-like body portion comprising plural apertures and a stop portion extending upwardly from the base portion, the first end portion of the first stove body section comprising an access opening with an access door, the grate being insertable into the first end portion through the access opening when the access door is opened and being removable from the access opening when the access door is closed, the stop portion engaging the pellet guiding tube to limit the insertion of the grate into the first end portion.

6. A pellet stove according to claim 1 wherein the first and third sections are elongated with respective longitudinal axes that are substantially horizontal when the pellet stove is in use, and wherein the grate comprises a horizontal portion when the stove is in use, the horizontal portion of the grate comprising a plurality of apertures and wherein at least a plurality of apertures on the horizontal portion of the grate are positioned horizontally closer to the second end than the shortest horizontal distance between the pellet tube outlet and the second end.

7. A pellet stove according to claim 1 comprising a plurality of legs detachably mounted to the first section, wherein the legs are adjustable in height.

8. A pellet stove according to claim 7 comprising first and second spaced apart elongated rails mounted to the first section, the rails defining handles and projecting upwardly above an upper surface of the first section, the elongated rails defining leg receiving storage areas for storing the legs when detached, the rails also defining a stored leg supporting surface between the first and second sections.

9. A pellet stove according to claim 1 comprising a hopper for receiving a supply of pellets, the hopper comprising a hopper outlet in communication with the pellet material inlet, and a gate for selectively allowing the flow of pellets from the hopper to the pellet material inlet, the hopper extending upwardly with the top of the hopper extending above the height of the third section when the stove is in use, and the at least partially open zone being lower in elevation than the top of the hopper.

10. A pellet stove according to claim 9 in which the pellet material supporting grate comprises an upwardly extending inclined plate portion, the pellet guiding tube comprising a pellet feed tube in communication with the pellet material inlet, the pellet feed tube being angled downwardly and inwardly into the combustion chamber, wherein pellets flowing from the pellet material inlet and through the feed tube are directed both downwardly and in the first direction along the pellet material plate portion and onto the apertured portion of the pellet supporting grate.

11. A pellet stove according to claim 1 wherein each of the first, second and third sections have a rectangular cross-section.

12. A pellet stove according to claim 1 sized so as to be portable.

13. A pellet stove comprising:

a first elongated section having a first longitudinal axis that is substantially horizontal when the pellet stove is in a use position, the first elongated section having first and second end portions, the first elongated section comprising a combustion chamber portion at the first end portion of the first elongated section and a first air flow conduit portion, the first air flow conduit portion comprising a first conduit end portion with an inlet communicating with the combustion chamber and a second conduit end portion at the second end portion of the first elongated section and spaced in a first direction from the combustion chamber;

the combustion chamber portion comprising a pellet material receiving inlet adjacent to the first end through which pellets are delivered by gravity flow into the combustion chamber portion;

a pellet flow guide positioned to direct pellet material from the pellet material inlet downwardly and forwardly in the first direction away from the pellet material receiving inlet;

a pellet supporting grate positioned to receive pellets delivered to the combustion chamber portion;

a combustion air flow passageway communicating with the combustion chamber for delivery of combustion air upwardly to pellets on the pellet supporting grate, with at least some of the combustion air being directed upwardly through the grate at locations positioned in the first direction from the pellet flow guide and from the pellet material inlet;

an air flow conduit comprising at least the first conduit portion and a second conduit portion coupled to the first conduit portion and having an outlet, the first air flow conduit portion comprising a lower conduit portion and the second air flow conduit portion comprising an upper conduit portion, the upper conduit portion at least partially overlaying the lower conduit portion, the upper conduit portion being oriented to direct the air flow in a direction substantially opposite to the direction of air flow through the lower conduit portion such that the upper air flow conduit defines a flow reversing air flow conduit, and both the upper and lower air flow conduits including windowless exterior walls that are exposed to the ambient environment when the stove is in use; and wherein the combustion air flow passageway is defined at least in part by an ash drawer receiving housing positioned below the pellet supporting grate with the combustion air inlet being at one end portion of the ash drawer receiving housing, and comprising an ash receiving drawer positioned beneath the pellet supporting grate when the ash receiving drawer is either inserted into the ash drawer receiving housing to a closed position or partially removed from the ash drawer receiving housing to partially open positions, the ash receiving drawer comprising an end portion sized to close the combustion air inlet opening when the ash receiving drawer is in the closed position and to open the combustion air inlet to increase the access of combustion air through the combustion air inlet and upwardly into the combustion chamber as the ash receiving drawer is moved from the closed position to partially open positions or from one partially open position to a further open partially open position.

14. A pellet stove according to claim 13 wherein the upper and lower conduit portions are spaced apart with a stove component free open space being provided between the upper and lower conduit portions.

15. A pellet stove comprising:

a first elongated tube section comprising an upper surface, a lower surface, first and second end portions, a first end adjacent to the first end portion, a second end adjacent to the second end portion, and a first longitudinal axis;

a first end cap coupled to the first tube section and movable from a first position closing the first end of the first tube section to a second position at least partially opening the first end of the first tube section;

plural legs detachably coupled to the first elongated tube section for supporting the first tube section with the first longitudinal axis in approximately a horizontal orientation;

the first end portion comprising a combustion chamber, a pellet fuel inlet positioned in an upper surface of the first tube section and located at the first end portion, a pellet hopper having a lower pellet outlet connected to the pellet fuel inlet, a pellet fuel feed tube extending into the interior of the combustion chamber from the pellet fuel inlet, the portion of the fuel feed tube positioned in the interior of the combustion chamber being angled from the pellet fuel inlet in a direction downwardly from the pellet fuel inlet and away from the first end of the first tube section and toward the second end portion of the first tube section, the pellet fuel tube comprising a fuel tube inlet communicating with the pellet fuel inlet and a fuel tube outlet, the fuel tube outlet being positioned at a location that is at a distance in a first direction parallel to the longitudinal axis that is nearer to the second end than the distance in the first direction of the pellet fuel inlet to the second end;

the first end portion comprising a combustion air inlet opening through the lower surface of the first elongated tube section and communicating with the combustion chamber;

a pellet fuel supporting grate comprising an apertured portion overlying the combustion air inlet opening, the apertured portion comprising a plurality of apertures, the pellet fuel supporting grate being located to receive pellet fuel from the fuel feed tube so as to support a bed of pellet fuel for combustion on the fuel supporting grate with at least a portion of the combustion air flowing upwardly through the fuel supporting grate, the fuel supporting grate being insertable and removable through the first end upon opening the first end cap, at least a first plurality of the apertures of the apertured portion being positioned in the first direction nearer to the second end than the fuel tube outlet;

an ash receiving drawer slidably coupled to the first tube section at a location below the access door, the ash receiving drawer comprising an upwardly facing ash receiving opening positioned beneath at least the apertured portion of the fuel supporting grate, the ash drawer comprising a portion of a combustion air flow passageway communicating from the exterior of the stove with the combustion air inlet opening, one portion of the combustion air flow passageway extending upwardly through the first plurality of the apertures positioned in the first direction nearer to the second end than the first tube inlet spaced from the fuel feed tube apertures, the ash drawer being slidable from a closed position in which the ash drawer covers the combustion flow passageway to partially open positions to provide additional access for combustion air through the combustion air flow passageway and wherein sliding the ash drawer from a first partially open position to a second partially open position that is more open than the first position increases the access for combustion air through the combustion air flow passageway, the ash receiving drawer being removable from the first tube section;

an upright second tube section having a lower end portion coupled to the second end portion of the first tube section, the second tube section also comprising an upper end portion;

an elongated third tube section having a first end portion coupled to the upper end portion of the second tube section, the third tube section having a second longitudinal axis, the third tube section overlying and being spaced from the first tube section and being shorter than the first tube section with a space between the first and third tube sections, the third tube section also comprising a second end portion with an outlet opening; and the space between the first tube section and third tube sections comprising an at least partially open heating zone.

16. A pellet stove according to claim 15 comprising first and second elongated spaced apart handles mounted to the first section and projecting upwardly above the top surface, the handles comprising a support for the heating zone.

17. A pellet stove according to claim 16 wherein the space between the first tube section and the third tube section is entirely unobstructed except for the handles.

18. A pellet stove according to claim 15 wherein the first and second longitudinal axes are parallel to one another.

19. A pellet stove according to claim 15 wherein at least the first tube section is of a rectangular cross-section.

20. A pellet stove according to claim 19 wherein the first tube section is no greater than about six inches high and six inches wide.

21. A pellet stove according to claim 15 wherein the fuel supporting grate portion comprises an apertured base portion that extends in the first direction and an apertured fuel guide portion extending upwardly from the base portion of the grate, the fuel guide portion being sized to abut the fuel tube to limit the insertion of the grate, the first end of the first enlongated tube section, the fuel guide portion being angled to guide the flow of fuel from the fuel feed tube away from the pellet fuel inlet and onto the fuel supporting grate.

22. A pellet stove according to claim 20 further comprising a gated hopper coupled to the pellet fuel inlet from which pellets positioned in the hopper are delivered by gravity to the pellet fuel inlet upon opening the gate of the hopper, the hopper extending above the first, second and third tube sections.

23. A pellet stove according to claim 15 wherein the legs are adjustable in height.

24. A pellet stove according to claim 16 wherein the handles comprise a leg storage area therebetween sized to receive the legs when the legs are detached from coupling to the first tube section.

25. A pellet stove according to claim 15 wherein at least a majority of the combustion air flows upwardly through the fuel supporting grate.

26. A pellet stove according to claim 1 wherein the grate comprises a substantially horizontal apertured portion, a majority of the apertures of the substantially horizontal apertured portion of the grate are positioned at locations spaced in the first direction from the pellet guiding tube outlet and nearer to the second end of the first section than the pellet guiding tube outlet to provide a path for the flow of at least some of the combustion air at locations nearer to the second end of the first section than the pellet guiding tube outlet.

* * * * *

UNITED STATES PATENT AND TRADEMARK OFFICE

CERTIFICATE OF CORRECTION

PATENT NO. : 8,020,547 B2
APPLICATION NO. : 11/890688
DATED : September 20, 2011
INVENTOR(S) : Hepper et al.

It is certified that error appears in the above-identified patent and that said Letters Patent is hereby corrected as shown below:

In the Specification:

Column 6, line 42, "chamber a pellet" should read -- chamber, a pellet --

Column 7, line 54, "outlet:" should read -- outlet; --

Signed and Sealed this
Thirtieth Day of July, 2013

Teresa Stanek Rea
*Acting Director of the United States Patent and Trademark Office*